US008242440B2

(12) United States Patent
Splendore et al.

(10) Patent No.: US 8,242,440 B2
(45) Date of Patent: Aug. 14, 2012

(54) METHOD AND APPARATUS FOR AN ION TRANSFER TUBE AND MASS SPECTROMETER SYSTEM USING SAME

(75) Inventors: Maurizio A. Splendore, Walnut Creek, CA (US); Eloy R. Wouters, San Jose, CA (US); Paul R. Atherton, San Jose, CA (US); Jean Jacques Dunyach, San Jose, CA (US)

(73) Assignee: Thermo Finnigan LLC, San Jose, CA (US)

( * ) Notice: Subject to any disclaimer, the term of this patent is extended or adjusted under 35 U.S.C. 154(b) by 246 days.

(21) Appl. No.: 12/434,540

(22) Filed: May 1, 2009

(65) Prior Publication Data

US 2010/0276584 A1 Nov. 4, 2010

(51) Int. Cl.
*H01J 49/04* (2006.01)

(52) U.S. Cl. ..... 250/288

(58) Field of Classification Search ..... 250/288
See application file for complete search history.

(56) References Cited

U.S. PATENT DOCUMENTS

| | | | | |
|---|---|---|---|---|
| 4,855,594 | A | 8/1989 | Kimock et al. | |
| 5,130,538 | A * | 7/1992 | Fenn et al. | 250/282 |
| 5,157,260 | A * | 10/1992 | Mylchreest et al. | 250/423 R |
| 5,245,186 | A | 9/1993 | Chait et al. | |
| 5,298,744 | A * | 3/1994 | Mimura et al. | 250/288 |
| 5,304,798 | A | 4/1994 | Tomany et al. | |
| 5,965,883 | A | 10/1999 | Lee et al. | |
| 6,087,657 | A | 7/2000 | Kato | |
| 6,107,628 | A | 8/2000 | Smith et al. | |
| 6,455,846 | B1 | 9/2002 | Prior et al. | |
| 6,667,474 | B1 | 12/2003 | Abramson et al. | |
| 6,703,611 | B2 | 3/2004 | Glish et al. | |
| 6,777,672 | B1 | 8/2004 | Park | |
| 6,824,083 | B2 | 11/2004 | Okuda et al. | |
| 6,832,733 | B2 | 12/2004 | Engel | |
| 6,938,988 | B2 | 9/2005 | Clark et al. | |
| 7,009,176 | B2 | 3/2006 | Thakur | |
| 7,081,620 | B2 | 7/2006 | Kato | |
| 7,259,371 | B2 | 8/2007 | Collings et al. | |
| 7,514,673 | B2 * | 4/2009 | Senko et al. | 250/281 |
| 2003/0062474 | A1 * | 4/2003 | Baranov et al. | 250/288 |
| 2003/0160166 | A1 | 8/2003 | Glish et al. | |
| 2005/0116163 | A1 | 6/2005 | Park | |

(Continued)

FOREIGN PATENT DOCUMENTS

GB 2 299 445 A 10/1996

(Continued)

OTHER PUBLICATIONS

Fenn et al., "Electrospray Ionization for Mass Spectrometry of Large Biomolecules," Science (1989), vol. 246, pp. 64-71.

(Continued)

*Primary Examiner* — Jack Berman
(74) *Attorney, Agent, or Firm* — Thomas F. Cooney

(57) ABSTRACT

A method for analyzing a sample comprising the steps of: generating ions from the sample within an ionization chamber at substantially atmospheric pressure; entraining the ions in a background gas; transferring the background gas and entrained ions to an evacuated chamber of a mass spectrometer system using a single-piece capillary having an inlet end and an outlet end, wherein a portion of the capillary adjacent to the outlet end comprises an inner diameter that is greater than an inner diameter of an adjoining portion of the capillary; and analyzing the ions using a mass analyzer of the mass spectrometer system.

21 Claims, 13 Drawing Sheets

U.S. PATENT DOCUMENTS

| | | | |
|---|---|---|---|
| 2007/0079704 | A1 | 4/2007 | McAnespie |
| 2008/0073555 | A1 | 3/2008 | Dunyach et al. |
| 2008/0116370 | A1 | 5/2008 | Splendore et al. |
| 2008/0116371 | A1 | 5/2008 | Wouters et al. |
| 2008/0142698 | A1 | 6/2008 | Atherton et al. |
| 2009/0045062 | A1 | 2/2009 | Senko et al. |

FOREIGN PATENT DOCUMENTS

| | | | |
|---|---|---|---|
| JP | 11-108894 | A | 4/1999 |
| WO | WO 2010/039512 | A1 | 4/2010 |

OTHER PUBLICATIONS

Lin et al., "Ion Transport by Viscous Gas Flow through Capillaries," J Am Soc Mass Spectrom (1994), vol. 5, pp. 873-885.

W.M.A. Niessen, "State-of-the-art in liquid chromatography-mass spectrometry," J. Chromatogr. A, vol. 856 (1999), pp. 179-197.

Wu et al., "Incorporation of a Flared Inlet Capillary Tube on a Fourier Transform Ion Cyclotron Resonance Mass Spectrometer," Journal, Am Soc Mass Spectrom 2006, 17, pp. 772-779.

* cited by examiner

METHOD AND APPARATUS FOR AN ION TRANSFER TUBE AND MASS SPECTROMETER SYSTEM USING SAME

FIELD OF THE INVENTION

This invention generally relates to mass spectrometer systems, and more specifically to an ion transfer tube for transporting ions between regions of different pressure in a mass spectrometer.

BACKGROUND OF THE INVENTION

Ion transfer tubes are well-known in the mass spectrometry art for transporting ions from an ionization chamber, which typically operates at or near atmospheric pressure, to a region of reduced pressure. Generally described, an ion transfer tube typically consists of a narrow elongated conduit having an inlet end open to the ionization chamber, and an outlet end open to the reduced-pressure region. Ions formed in the ionization chamber (e.g., via an electrospray ionization (ESI) or atmospheric pressure chemical ionization (APCI) process), together with partially desolvated droplets and background gas, enter the inlet end of the ion transfer tube, traverse its length under the influence of the pressure gradient, and exit the outlet end into a lower-pressure chamber—namely, the first vacuum stage of a mass spectrometer. The ions subsequently pass through apertures in one or more partitions, such apertures possibly in skimmer cones, through regions of successively lower pressures and are thereafter delivered to a mass analyzer for acquisition of a mass spectrum.

FIG. 1 is a simplified schematic diagram of a general conventional mass spectrometer system comprising an atmospheric pressure ionization (API) source coupled to an analyzing region via an ion transfer tube. Referring to FIG. 1, an API source 12 housed in an ionization chamber 14 is connected to receive a liquid sample from an associated apparatus such as for instance a liquid chromatograph or syringe pump through a capillary 7. The API source 12 optionally is an electrospray ionization (ESI) source, a heated electrospray ionization (H-ESI) source, an atmospheric pressure chemical ionization (APCI) source, an atmospheric pressure matrix assisted laser desorption (MALDI) source, a photoionization source, or a source employing any other ionization technique that operates at pressures substantially above the operating pressure of mass analyzer 28 (e.g., from about 1 torr to about 2000 torr). Furthermore, the term API source is intended to include a "multi-mode" source combining a plurality of the above-mentioned source types. The API source 12 forms charged particles 9 (either ions or charged droplets that may be desolvated so as to release ions) representative of the sample, which charged particles are subsequently transported from the API source 12 to the mass analyzer 28 in high-vacuum chamber 26 through at least one intermediate-vacuum chamber 18. In particular, the droplets or ions are entrained in a background gas and transported from the API source 12 through an ion transfer tube 16 that passes through a first partition element or wall 11 into an intermediate-vacuum chamber 18 which is maintained at a lower pressure than the pressure of the ionization chamber 14 but at a higher pressure than the pressure of the high-vacuum chamber 26. The ion transfer tube 16 may be physically coupled to a heating element or block 23 that provides heat to the gas and entrained particles in the ion transfer tube so as to aid in desolvation of charged droplets so as to thereby release free ions.

Due to the differences in pressure between the ionization chamber 14 and the intermediate-vacuum chamber 18 (FIG. 1), gases and entrained ions are caused to flow through ion transfer tube 16 into the intermediate-vacuum chamber 18. A plate or second partition element or wall 15 separates the intermediate-vacuum chamber 18 from either the high-vacuum chamber 26 or possibly a second intermediate-pressure region (not shown), which is maintained at a pressure that is lower than that of chamber 18 but higher than that of high-vacuum chamber 26. Ion optical assembly or ion lens 20 provides an electric field that guides and focuses the ion stream leaving ion transfer tube 16 through an aperture 22 in the second partition element or wall 15 that may be an aperture of a skimmer 21. A second ion optical assembly or lens 24 may be provided so as to transfer or guide ions to the mass analyzer 28. The ion optical assemblies or lenses 20, 24 may comprise transfer elements, such as, for instance a multipole ion guide, so as to direct the ions through aperture 22 and into the mass analyzer 28. The mass analyzer 28 comprises one or more detectors 30 whose output can be displayed as a mass spectrum. Vacuum port 13 is used for evacuation of the intermediate-vacuum chamber and vacuum port 19 is used for evacuation of the high-vacuum chamber 26.

FIG. 2 is a schematic illustration of a portion, in particular, an outlet portion 50 of a known ion transfer tube. The upper and lower parts of FIG. 2 respectively show a cross-sectional view and a perspective view of the outlet portion 50. The ion transfer tube comprises a tube 52 (in this example, cylindrical tube) having a hollow interior or bore 54, the flow direction through which is indicated by the dashed arrow. At the outlet end 51 of the ion transfer tube, the tube 52 is terminated by a substantially flat end surface 56 that is substantially perpendicular to the length of the tube and to the flow direction. Further, a beveled surface or chamfer 58, which in the case of the cylindrical tube shown is a frustoconical surface, is disposed at an angle to the end surface so as to intersect both the end surface 56 and the outer cylindrical surface of the tube 52. The surface 58 may be used to align and seat outlet end of the ion transfer tube against a mating structural element (not shown) in the interior of the intermediate vacuum chamber 18 or may be used so as to penetrate, upon insertion into a mass spectrometer instrument, a vacuum sealing element or valve, such as the sealing ball disclosed in U.S. Pat. No. 6,667,474, in the names of Abramson et al., said patent incorporated by reference herein in its entirety.

Generally, there is a differential pressure of 750 to 760 Torr across the length of the ion transfer tube (e.g., ion tube 16 of FIG. 1), which leads to an expansion at the outlet end. This expansion is characterized by a rapid increase of the velocity of the ionized analyte containing gas that flows into the first vacuum stage of the mass spectrometer. Under some configurations, the expanding plume may even become supersonic and shockwaves may occur within the lower pressure chamber. It is to be appreciated that this expansion may lead to less-than-optimal conditions to transfer ions across the vacuum interface, and could for instance lead to a suppression of certain ions based on their charge state.

The number of ions delivered to the mass analyzer (as measured by peak intensities or total ion count) is partially governed by the flow rate through the ion transfer tube. It is generally desirable to provide relatively high flow rates through the ion transfer tube so as to deliver greater numbers of ions to the mass analyzer and achieve high instrument sensitivity. Although the flow rate through the ion transfer tube may be increased by enlarging the tube bore (inner diameter), such enlargement of the ion transfer tube diameter results in an increased gas load that, in the absence of increased pumping capacity, causes the pressures in the vacuum chambers to increase as well. Since it is necessary to maintain the mass analyzer and detector region under high vacuum conditions, the increase in pressure must be counteracted by increasing the number of vacuum pumps employed and/or increasing the pumping capacity of the vacuum pumps. Of course, increasing the number and/or capacity of the vacuum pumps also increases the cost of the mass spectrometer, as well as the power requirements, shipping weight and cost, and bench space requirements. Thus, for practical reasons, the inner diameter of an ion transfer tube is relatively small, on the order of 500 microns.

The forced flow of background gas and entrained ionized analyte through a small diameter ion transfer tube may cause a significant increase in velocity of the background gas and analyte. In some configurations, in which the ion transfer tube is short (approaching a simple aperture) and possibly shaped as a de Laval nozzle, the flow may become supersonic upon exiting the outlet end of the ion transfer tube. More generally, however, viscous drag against the tube interior will maintain the flow within the tube, and possibly exiting the tune, at sub-sonic velocities. Under such conditions, the Reynolds number, Re, for fluid flow in a pipe may apply, where this dimensionless quantity is defined as:

$$Re = \frac{\rho v L}{\eta}$$

in which $\rho$ is density (kg/m$^3$), $v$ is the velocity (m/s), L is a characteristic length and $\eta$ is the fluid viscosity (Pa-s).

Because of the low cross-sectional area of the ion transfer tube and expected high flow rates within the tube the flow regime in the tube may, the Reynolds number for flow within the tube may correspond to a transition flow regime (neither fully-laminar nor fully-turbulent) and the Reynolds number for the expanding plume exiting the tube may correspond to either transition or turbulent flow. Unfortunately, this non-laminar and possibly turbulent flow exiting the ion transfer tube often results in many of the ions failing to flow into downstream apertures and chambers of the device. Moreover, ions which follow the resulting off-line trajectories within the intermediate-vacuum chamber may encounter curved fringing electric fields from various ion optical elements in the apparatus. Ions with lower mass-to-charge ratio (m/z) may be expected to be more susceptible to trajectory-bending effects of such fields, thereby resulting in (m/z)-selective ion loss.

On a more practical matter, to manufacture these ion transfer tubes with a well defined length, a de-burring step must be performed. This step leads to small irreproducible differences between capillary specimens. The inventors have experimentally observed that these surface variations lead to (m/z)-dependent varying detected abundances of ions, and possibly even increased fragmentation of fragile ions such as peptides. The inventors have further experimentally determined that the use of an ion transfer tube in accordance with the present invention provides enhanced detected abundances of some ions whose relative proportions or absolute abundances are otherwise under-represented when a conventional ion transfer tube is employed. Even a specially made perfectly square tube end does not lead to a detected abundance of these ions that is comparable to that of the present invention, which employs a cylindrical tube interior having at least one diameter change.

It is thus hypothesized that the geometry or spread of turbulent or otherwise disturbed or perturbed flow at the outlet end of an ion transfer tube may be highly dependent upon small variations of viscous drag related to minor shape variations or to the presence of sharp corners, surface roughness or other irregularities at the outlet end of the ion transfer tube. The hypothesized resulting variable and uncontrolled flow exiting the conventional ion transfer tube may then lead to dispersal of ions away from a nominal instrumental trajectory thereby leading to either actual physical loss from the instrumental system or, possibly, fragmentation of fragile ions upon encountering regions of high RF voltage. Providing a special tool to produce exact replicas that avoid such variations would lead to an expected increase in manufacturing costs.

Regardless of the exact causes, the above-noted effects of decreased transmission efficiency, selective ion loss, and possibly ion fragmentation appear to have not been previously recognized, as it appears that transmission efficiency variations related to outlet-end variations of the ion transfer tube have generally been at least partially counteracted, in practice, by adjustment of the placement of the tube or ion optic elements, variation of chamber pressure, or other operating parameters. However, not all apparatus configurations may admit such adjustments. There is thus a need for an ion transfer tube geometry that can provide high ion transmission efficiency and that can be easily and cost-effectively reproducibly manufactured. The instant teachings provide a solution to this important problem.

SUMMARY

A method for analyzing a sample in accordance with the instant teachings comprises: generating ions from the sample within an ionization chamber at substantially atmospheric pressure; entraining the ions in a background gas; transferring the background gas and entrained ions to an evacuated chamber of a mass spectrometer system using a single-piece capillary having an inlet end and an outlet end, wherein a portion of the capillary adjacent to the outlet end comprises an inner diameter that is greater than an inner diameter of an adjoining portion of the capillary; and analyzing the ions using a mass analyzer of the mass spectrometer system.

Additionally, a mass spectrometer system in accordance with the instant teachings comprises: an ion source operable to generate ions from a sample at substantially atmospheric pressure; a mass analyzer in an interior of an evacuated housing operable to separate and detect the ions on the basis of mass-to-charge ratio; an intermediate-pressure chamber having an interior maintained at a pressure that is less than atmospheric pressure and greater than a pressure of the interior of the evacuated housing, the intermediate-pressure chamber having first and second apertures; a single-piece capillary coupled to the first aperture operable to transfer a background gas having the ions entrained therein into the intermediate-pressure chamber, the capillary having an inlet end and an outlet end, wherein a portion of the capillary adjacent to the outlet end comprises an inner diameter that is greater than an inner diameter of an adjoining portion of the capillary; ion optics disposed between the outlet end of the capillary and the second aperture operable to guide the ions exiting from the outlet end of the capillary to the second aperture; and at least one additional ion optical element operable to transfer ions from the second aperture to the mass analyzer.

The increase in diameter at the outlet end of the capillary allows the gas to expand while still in the capillary which reduces the velocity at the exit end thereby reduces the effect of exit turbulence and, possibly, shockwaves. The point where the diameter increases occurs sufficiently far into the capillary, with respect to the outlet end of the capillary, that a laminar flow is established with its associated radial velocity profile. Some benefits that are observed are an increased transmission of multiply charged ions as well as a decreased occurrence of fragmentation of fragile ions. An added benefit is that a capillary in accordance with the present teachings can be machined both in a very well defined manner (e.g. by drilling with a drill diameter in the range of the ID to the OD of the capillary) and without increasing tooling costs.

BRIEF DESCRIPTION OF THE DRAWINGS

The above noted and various other aspects of the present invention will become apparent from the following description which is given by way of example only and with reference to the accompanying drawings, not drawn to scale, in which.

DETAILED DESCRIPTION

The following description is presented to enable any person skilled in the art to make and use the invention, and is provided in the context of a particular application and its requirements. Various modifications to the described embodiments will be readily apparent to those skilled in the art and the generic principles herein may be applied to other embodiments. Thus, the present invention is not intended to be limited to the embodiments and examples shown but is to be accorded the widest possible scope in accordance with the features and principles shown and described.

To more particularly describe the features of the present invention, please refer to FIGS. 3 through 18 in conjunction with the discussion below.

Figure 13:
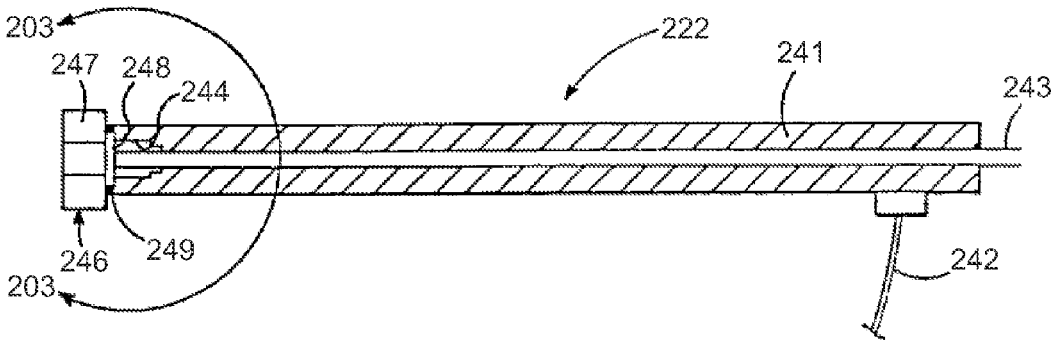
FIG. 13 shows a capillary assembly in accordance with one embodiment of the present invention.
Figure 14:
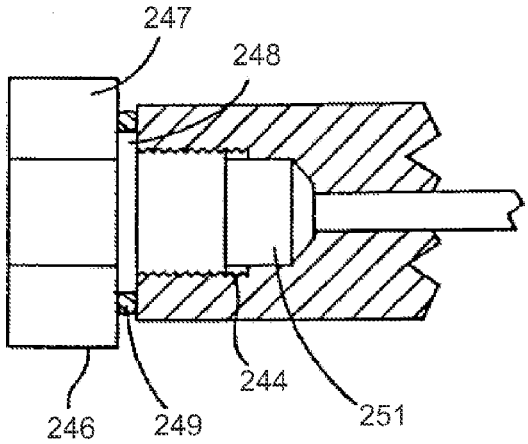
FIG. 14 is an enlarged view of the region 203-203 of FIG. 13.

Referring to FIGS. 13 and 14, a heated capillary tube assembly 222 is illustrated. The capillary tube assembly includes a cylindrical heater 241 which is electrically heated via the heater wire 242. A capillary tube 243 extends axially through the heater. The end of the heater includes a threaded bore portion 244 which receives the cooperating threads of the nut 246. More particularly, the nut includes a head which has wrench flats 247 to allow a tool to loosen or tighten the nut. A shoulder 248 which abuts against the mating face of the capillary heater precisely determines the distance between the nut and heater, and thus the amount of compression of the sealing o-ring 249. A compressible fitting 251 is compressed by the nut and urged against a capillary tube and heater to form a seal. Thus, the capillary can be easily removed by unthreading the nut and sliding the capillary along the axial bore of the heater assembly for removal and inspection or replacement. The capillary tube may, for example, be a steel capillary tube which slides into the mating bore of the heater body. The heater body is preferably made of a different metal such as an aluminum or bronze alloy to prevent the capillary tube and heater body from galling or seizing. The threads on the nut may be plated with a different metal such as silver or nickel to prevent galling of the threads to the heater body. Although a steel capillary tube has been described, the tube may be titanium, nickel, coated or lined e.g. glass lined, glass or other type of capillary tube known in the art. Although a heater body has been described for heating the capillary, the capillary tube may be directly resistively heated by applying a current along the tube which is mounted in a cylindrical body.

Figure 15:
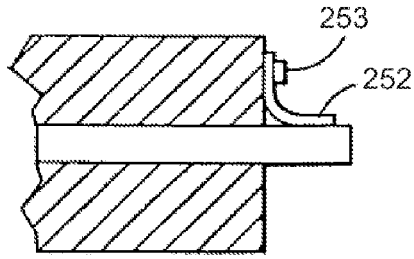
FIG. 15 is an enlarged view of the end portion of a capillary tube assembly including a flap for inhibiting venting of the mass analyzer system.

Referring to FIG. 15, the end of the heater assembly may be provided with a flap or seal 252 secured to the heater assembly by, for example, a screw 253, the flap being made of a resilient material so that when the capillary tube is withdrawn the flap closes the opening at the end of the heater assembly, thereby minimizing venting of high pressure gases into the low pressure adjacent chamber.

Figure 16:
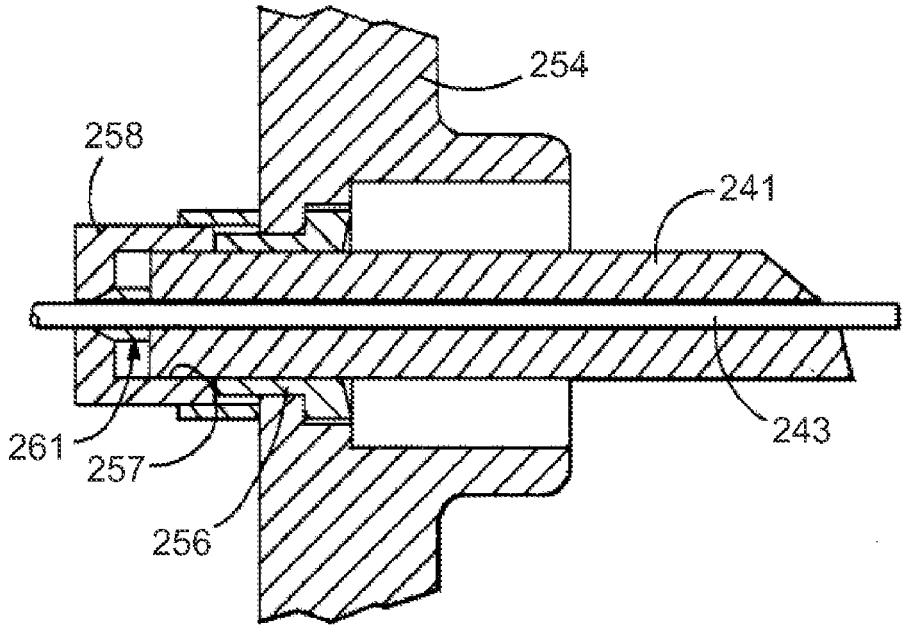
FIG. 16 is a partial view of the input end of a capillary assembly in accordance with another embodiment of the invention.

Referring to FIG. 16, another embodiment of the invention is illustrated. The body 241 is supported by the wall 254 between the atmospheric pressure chamber and the lower pressure chamber by a sleeve 256. The end of the body is provided with an external thread 257 which is adapted to receive a nut 258. The capillary tube 243 is inserted axially into the body 241. A compression fitting or ferrule 261 slides over the capillary, and the inclined surfaces of the ferrule and nut cooperate to compress the ferrule against the capillary tube to seal the tube to provide a seal for the capillary tube. The capillary tube is removed and replaced by unthreading the nut 258, sliding the capillary out of the body, and then re-inserting the cleaned capillary tube or a replacement capillary tube and tightening the nut.

Figure 17:
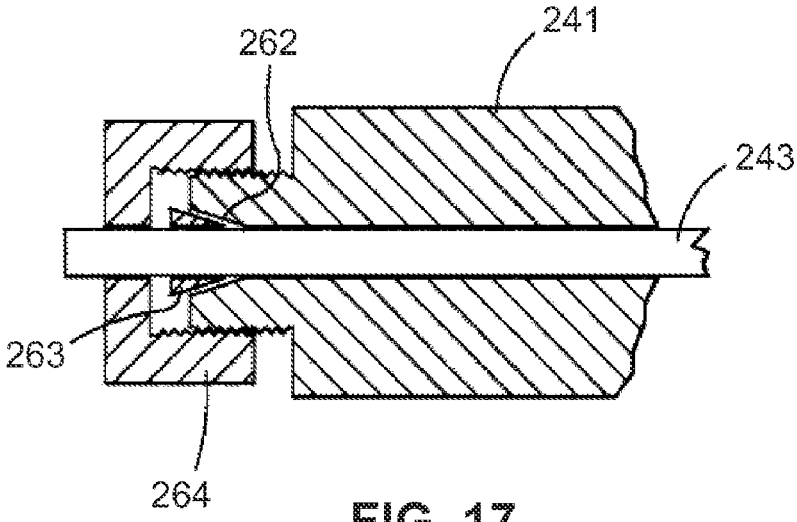
FIG. 17 is an enlarged view of the capillary assembly in accordance with still another embodiment of the invention.

FIG. 17 shows an alternate sealing assembly in which the interior bore of the heater body 241 is inclined 262 to receive the compressible sealing ring or ferrule 263 which is compressed against the capillary by tightening the nut 264.

Figure 18:
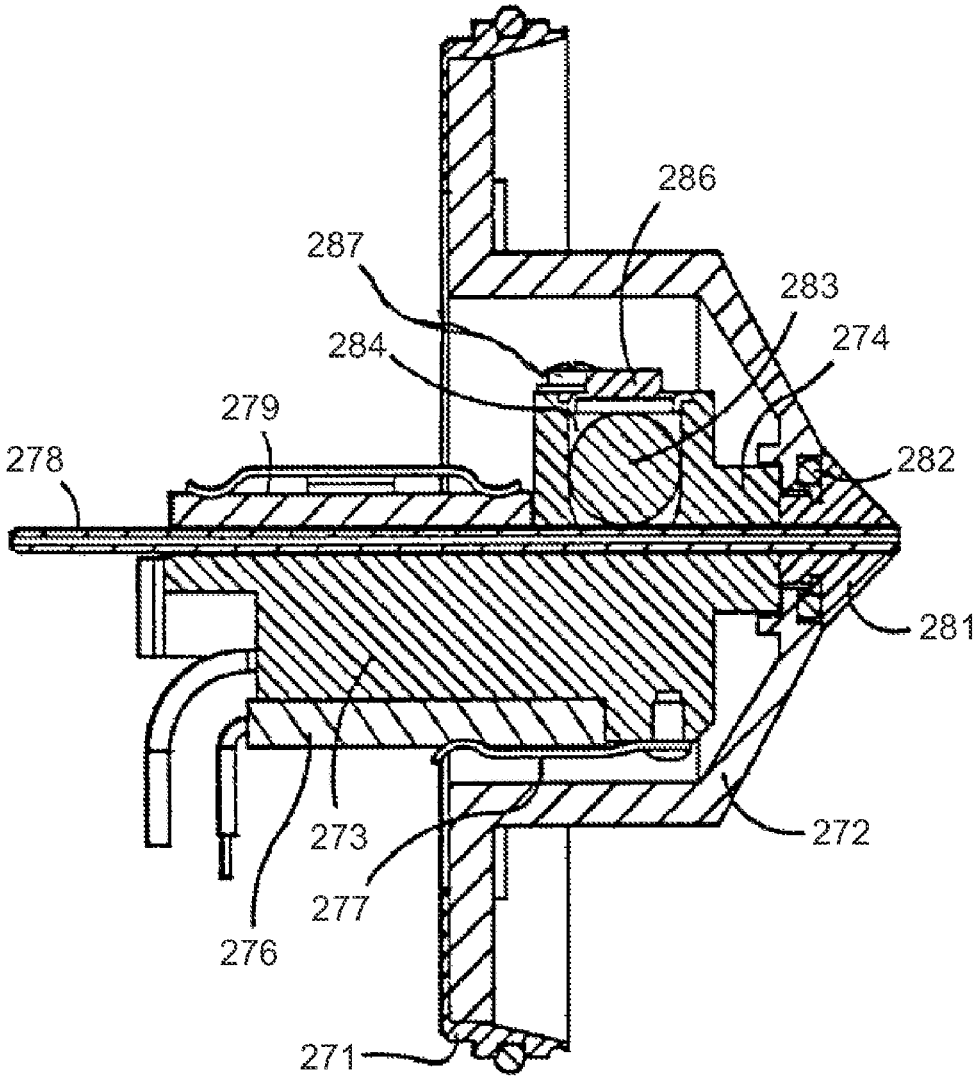
FIG. 18 is an enlarged view of a capillary assembly in accordance with a further embodiment of the present invention.

FIG. 18 shows another embodiment of the invention in which a wall 271 and shield 272 support a heated capillary assembly. The heater body 273 has one end 274 supported by the shield 272 and its central portion supported by the wall 271. A temperature sensor 276 is held against the heater body by spring 277. The heater body receives a capillary tube 278. The capillary tube is pressed against the heater body by a spring assembly 279. The end of the capillary tube is secured to a nut or fitting 281 having external threads which are received by the internal threads at the end of the heater 271. Thus, the capillary tube with its integral fitting 281 is screwed into the heater body and compresses an o-ring 282 to provide a seal. The heater assembly includes a sealing ball 283 which is retained in a well 284 formed in the heater assembly by a spring-loaded fitting 286 secured to the heater by screws 287. Thus, as the capillary tube is removed, the ball 283 seals the bore of the heater preventing venting of the lower pressure chamber.

Figure 2:
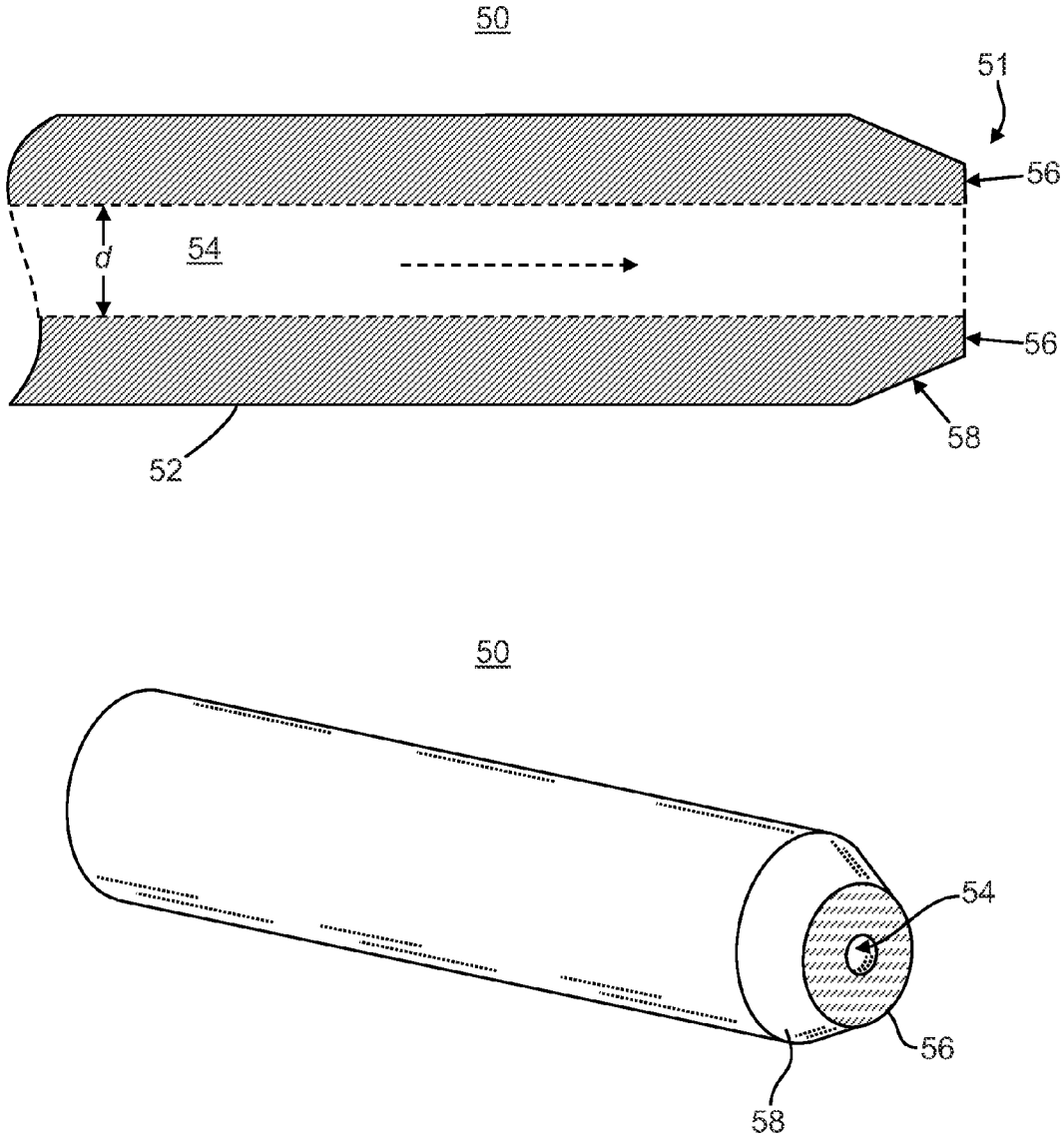
FIG. 2 (Prior Art)
FIG. 2 is a schematic illustration of a portion of a known ion transfer tube in both cross-sectional and perspective views.
Figure 3:
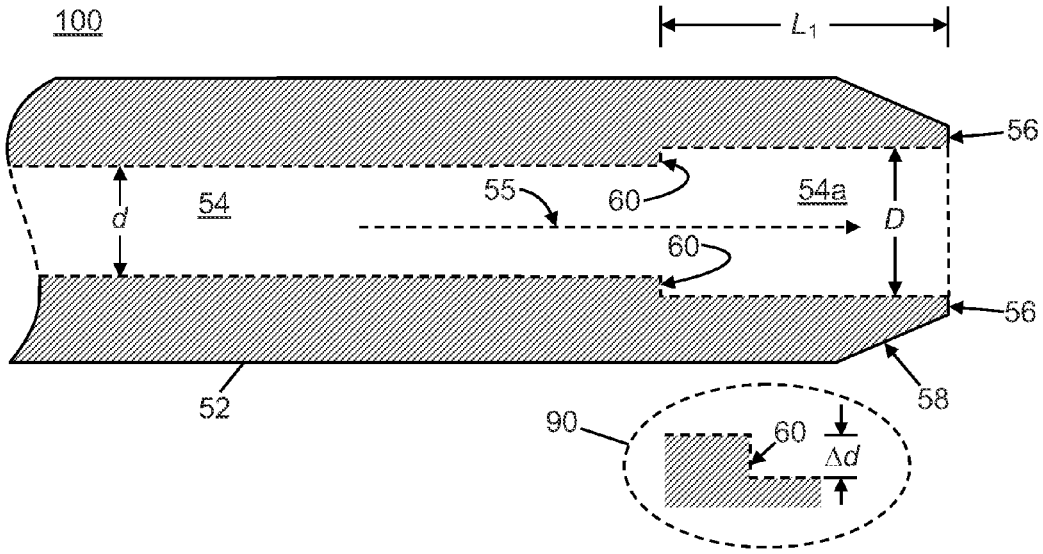
FIG. 3 is a cross sectional view of an ion transfer tube in accordance with various embodiments of the instant teachings.

FIG. 3 is a cross sectional view of a portion of an ion transfer tube, ion transfer tube 100, in accordance with various embodiments of the instant teachings. The reference numbers 51, 52, 54, 56 and 58 in FIG. 3 are defined similarly to like elements in FIG. 2. In contrast to the conventional ion transfer tube illustrated in FIG. 2, the hollow interior of the ion transfer tube illustrated in FIG. 3 comprises an expanded hollow interior portion or bore 54*a*, having larger inner diameter, D, than the diameter, d, of the main hollow interior portion or bore 54, at the outlet end of the ion transfer tube. The cross sections of the main hollow interior portion or bore 54 and of the expanded hollow interior portion or bore 54*a* are both circular, with D>d. Stated differently, the interior surfaces of the tube 52 defining these hollow interior portions are both cylindrical. Further, these cylindrical surfaces are both parallel to an axis 55. The expanded hollow interior portion or bore 54*a* adjoins the main hollow interior portion or bore 54 (along most of the length of the tube 52) by means of a step surface 60 of step height, Δd (see enlargement in inset 90 of FIG. 3), which is substantially perpendicular or normal to the axis 55. Note that the arrow along axis 55 denotes the flow direction.

Figure 4:
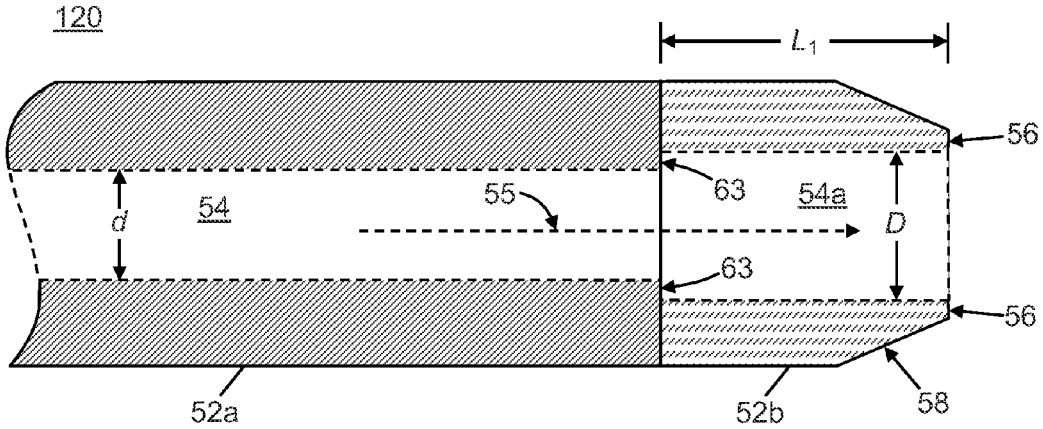
FIG. 4 is a cross sectional view of a second ion transfer tube in accordance with various embodiments of the instant teachings.

FIG. 4 is a cross sectional view of a portion of another ion transfer tube, ion transfer tube 120, in accordance with various alternative embodiments of the instant teachings. The ion transfer tube comprises a first tube member 52*a* adjoined to a second tube member 52*b* by an air-tight seal between the two tube members. The first tube member 52*a* has a hollow interior portion or bore 54 of circular cross section having an inner diameter d. The second tube member 52*b* has a hollow interior portion or bore 54*a* of circular cross section having an inner diameter D, where D>d. The flow of gas, together with entrained ions, is in the direction from the first tube member 52*a* to the second tube member 52*b* as indicated by the arrow along axis 55. Thus, tube member 52*b* comprises the gas and ion outlet of the ion transfer tube 120 and the difference in the inner diameters corresponding to the two tube members creates a step 63 to a greater diameter in the direction of flow.

Figure 5:
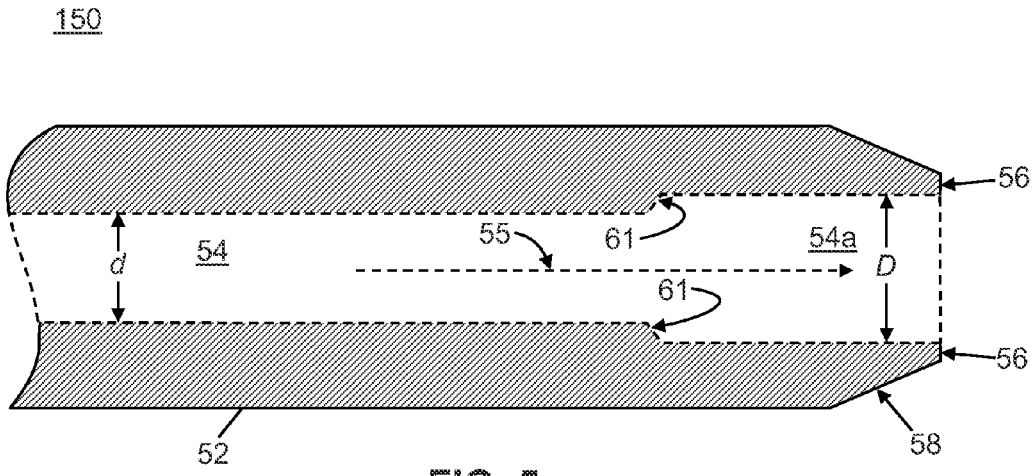
FIG. 5 is a cross sectional view of a third ion transfer tube in accordance with various embodiments of the instant teachings.

FIG. 5 is a cross sectional view of a portion of another ion transfer tube, ion transfer tube 150, in accordance with various alternative embodiments of the instant teachings. The ion transfer tube 150 is similar to the ion transfer tube 100 illustrated in FIG. 3, except that the expanded hollow interior portion or bore 54*a* adjoins the main hollow interior portion or bore 54 by means of a frustoconical surface 61.

Figure 6:
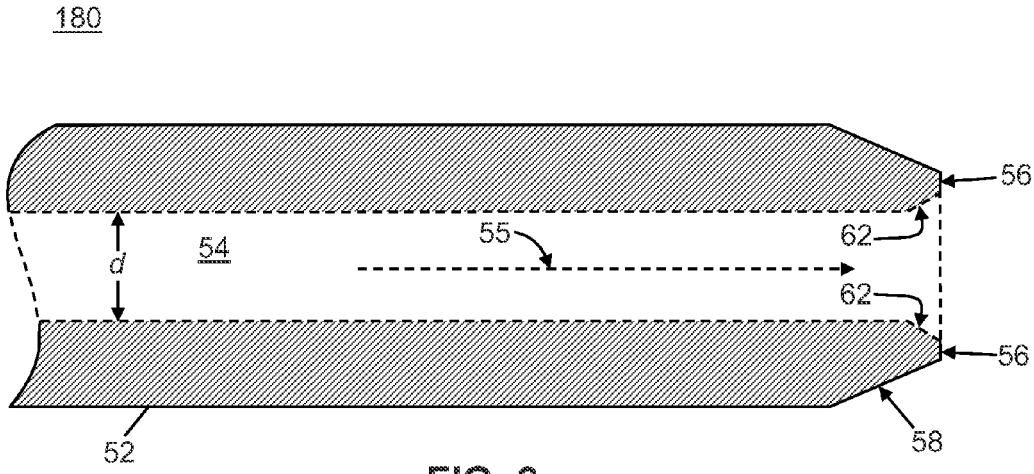
FIG. 6 is a cross sectional view of a fourth ion transfer tube in accordance with various embodiments of the instant teachings.

FIG. 6 is a cross sectional view of a portion of another ion transfer tube, ion transfer tube 180, in accordance with various other alternative embodiments of the instant teachings. The ion transfer tube 180 shown in FIG. 6 comprises a continuous diameter increase near the outlet end. The expanded diameter portion of the ion transfer tube 180 is limited to an interior volume section partially enclosed by frustoconical surface 62, which intersects the end surface 56. The region within the tube that is partially enclosed by frustoconical surface 62 may be referred to as a countersink.

Figure 7:
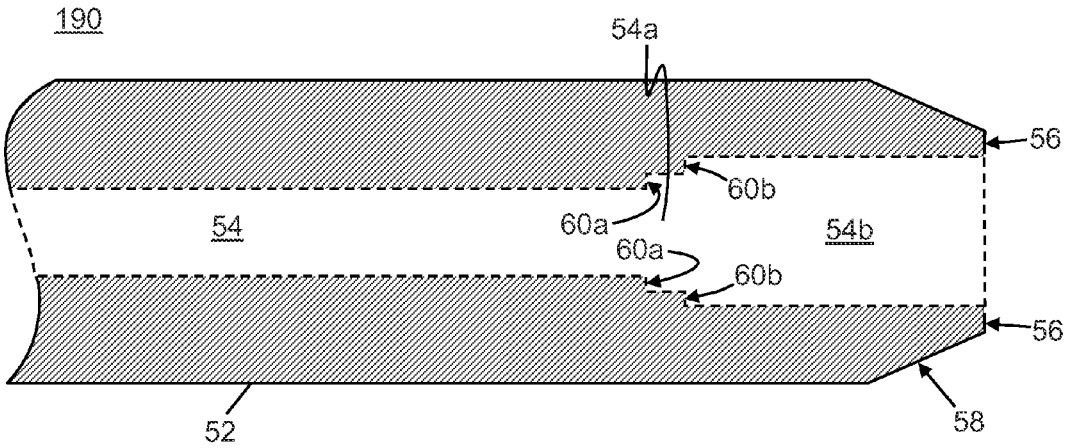
FIG. 7 is a cross sectional view of a fifth ion transfer tube in accordance with various embodiments of the instant teachings.

FIG. 7 is a cross sectional view of a fifth ion transfer tube in accordance with various embodiments of the instant teachings. The ion transfer tube 190 illustrated in FIG. 5 employs multiple backsteps so as to form more than one enlarged hollow interior region or bore, the different hollow interior regions or bores having increasing inner diameters in the direction of flow. In the example shown in FIG. 7, the ion transfer tube comprises two backsteps—a first backstep 60*a* which separates the main hollow interior portion or bore 54 from a first expanded hollow interior portion or bore 54*a* and a second backstep 60*b* which separates the first expanded hollow interior portion or bore 54*a* from a second expanded hollow interior portion or bore 54*b*. More than two such backsteps may be employed. Although the backstep surfaces are shown as perpendicular to the length of the ion transfer tube, they could also comprise bevel or chamfer surfaces.

The expanded hollow interior portion or bore 54*a* of ion transfer tube 100 shown in FIG. 3, which may be referred to as a counterbore, causes a decrease in velocity of subsonic gas and entrained ions and charged particles at the outlet end of the ion transfer tube. The second hollow interior portion or bore 54*a* of the ion transfer tube 120 (FIG. 4) produces a similar effect. This reduced velocity reduces the magnitude and effects of any turbulence or other flow perturbation or disturbance occurring as the background gas and entrained charged ions exit the outlet end of the ion transfer tube. The surface 60 is known as a "backstep" in the art of fluid flow.

Figure 11A:
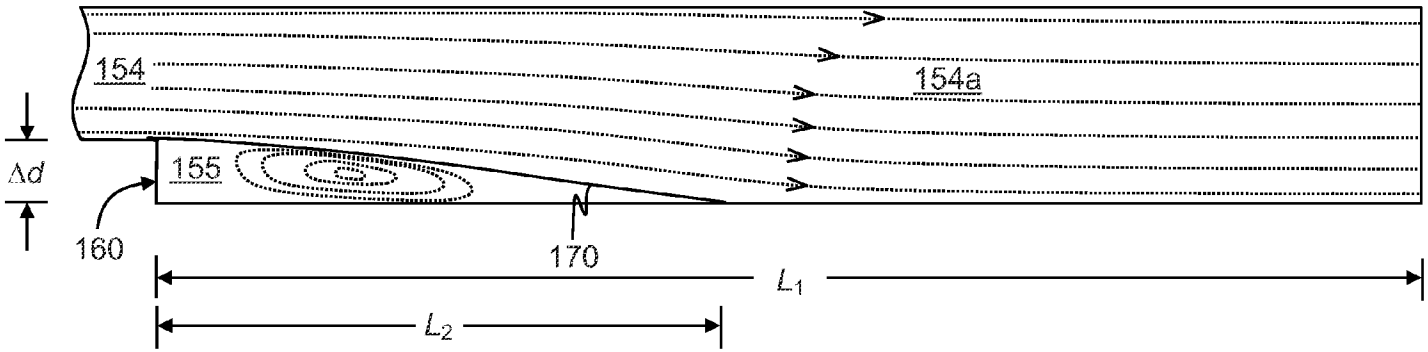
FIG. 11*a* is a schematic view stream lines of a fluid flowing in a tube having a step.
Figure 11B:
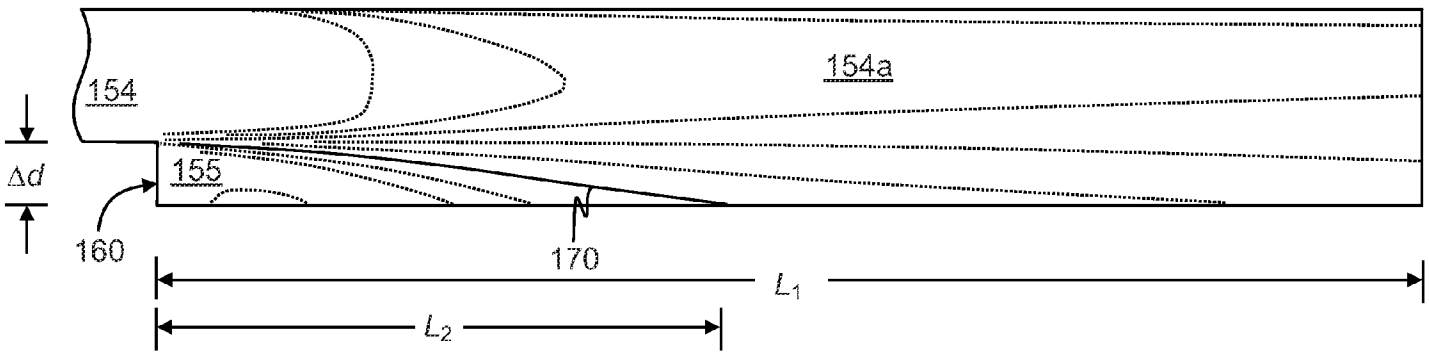
FIG. 11*b* is a schematic view of flow velocity contours of a fluid flowing in a tube having a step.

In the ion transfer tube 150 (FIG. 5), the backstep 61 is slightly angled as indicated in the figure. This angled configuration improves upon a perfectly square step (FIG. 3) because the angled step leads to less turbulence or other flow perturbation or disturbance within the tube. This within-tube turbulence effect is better illustrated in FIG. 11*a* and FIG. 11*b* which are, respectively, schematic representations of stream lines and velocity contours, as indicated by computational fluid dynamics calculations, in a tube having a single backstep surface 160 that is at a distance $L_1$ from the outlet end of the tube. In FIGS. 11*a* and 11*b*, the region 154 is a main hollow interior portion or bore of the tube and the region 154*a* is an expanded hollow interior portion or bore of the tube. As indicated by the calculations, the expanded hollow interior portion or bore 154*a* includes a region of turbulence 155 in the vicinity of the backstep 160 is separated from the laminar flow region by a detachment surface 170.

The simulation results depicted in FIGS. 11*a* and 11*b* indicate an overall decrease in velocity and flattening out of the velocity profile across the tube interior after the step. Also, note that in a cylindrically symmetric case (which is a better model of an ion transfer tube), there will be an increased thickness outer flow region shielding the faster-flowing central core region. The detachment surface terminates against the tube interior wall within a distance $L_2$ from the backstep 160. Thus, the fluid flow within the tube may re-attain a laminar flow regime at a distance ($L_1$-$L_2$) from the outlet end, provided that the backstep is set back far enough within the tube.

Depending upon various experimental and material parameters, the region 155 may represent a zone of turbulence or otherwise disturbed or perturbed flow. The length, $L_2$, of the region 155 increases as a function of increasing step-height $\Delta d$. Therefore, the length $L_1$, which is the distance from the backstep to the outlet end of the ion transfer tube, should be greater than $L_2$, and, preferably some multiple of $L_2$. Preferably, the distance $L_1$ should be greater than or equal to some multiple, m, of the step-height as given by the relation $L_1/\Delta d \geqq m$, for instance, m=6. For a practical minimum step-height of 10 μm (micro-meters), this latter relationship yields the result that $L_1 \geqq 60$ μM.

The provision of an angled backstep, as in FIG. 5, decreases the size of the turbulent or disturbed-flow zone 155 and reduces the length required to reestablish laminar flow. It is advantageous to machine the angled backstep 61 at a 59±5 degree angle relative to the tube axis, since this is a common cutting angle on a drill bit. As a perhaps less cost effective alternative to producing the expanded hollow interior portion or bore 54*a* by drilling, it can also be envisioned that the diameter change is produced with any other available machining technique, a non limiting example of which could be to spot erode the bore of the exit end of the ion transfer tube to an arbitrary shape. Electrochemical machining or electrical discharge machining could be employed for this purpose.

Figure 1:
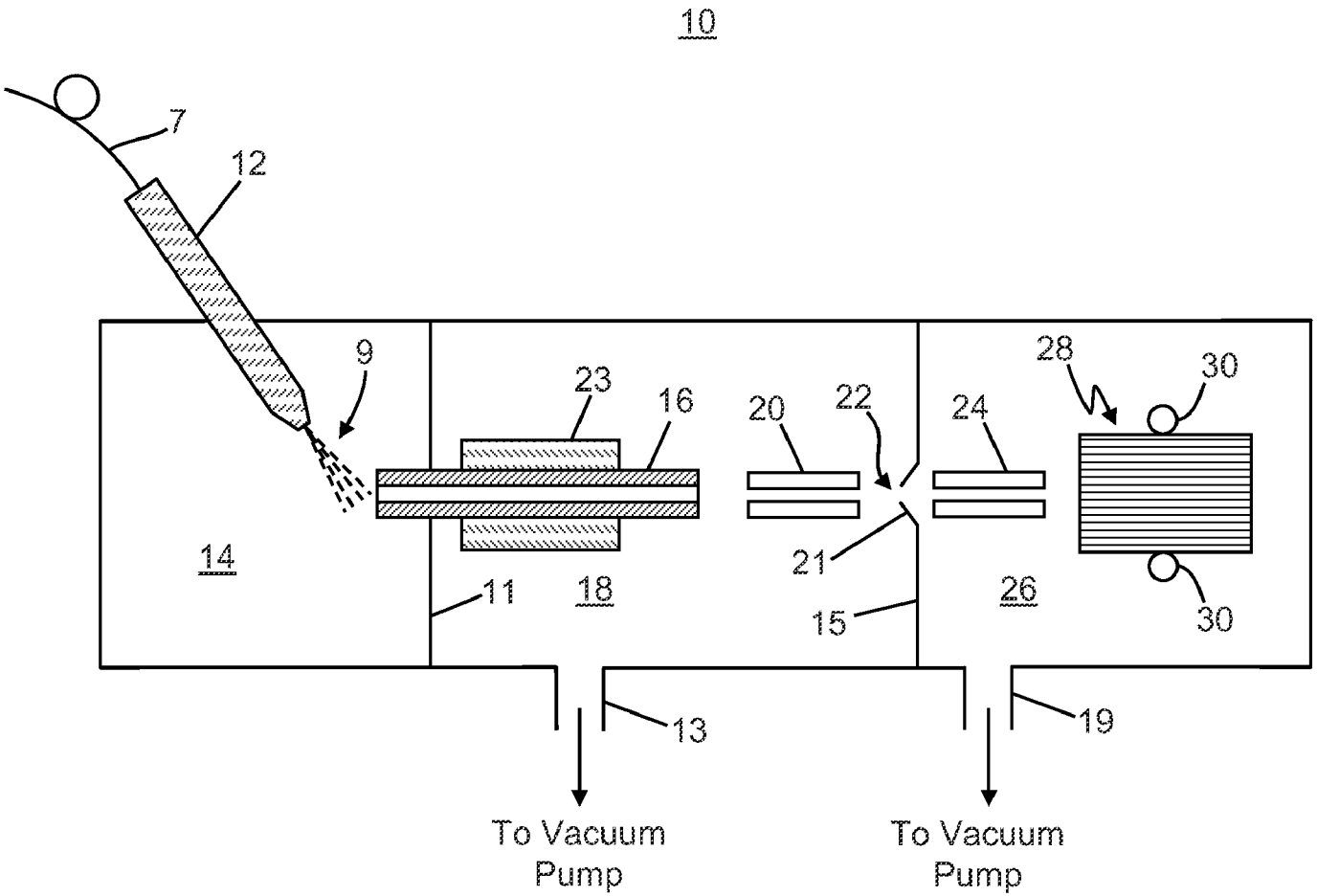
FIG. 1 (Prior Art)
FIG. 1 is a schematic illustration of a first example of a generalized conventional mass spectrometer system comprising an ion transfer tube.
Figure 8:
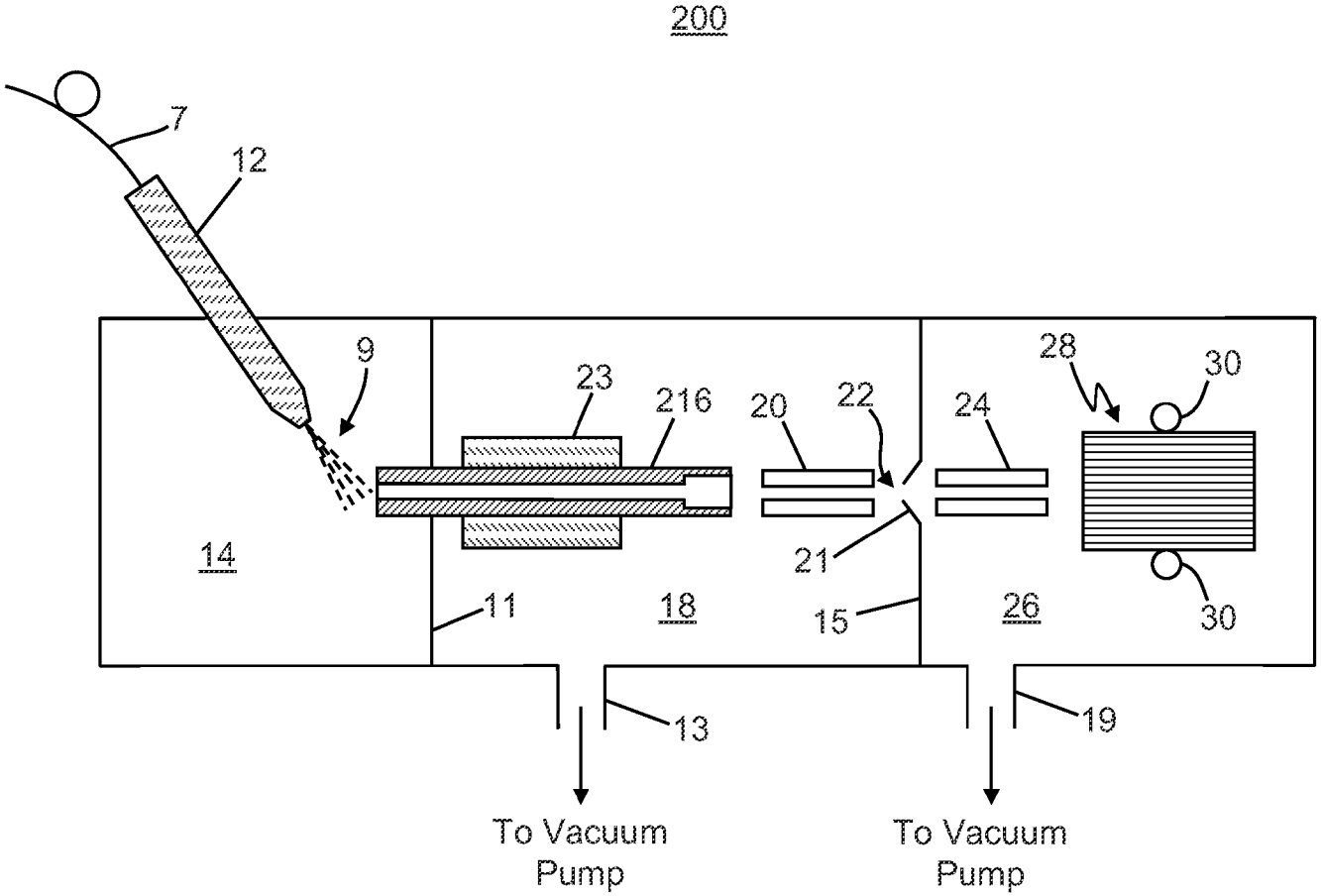
FIG. 8 is a schematic view of a mass spectrometer system in accordance with various embodiments of the instant teachings.

FIG. 8 is a schematic view of a mass spectrometer system in accordance with various embodiments of the instant teachings. In the mass spectrometer system 200 shown in FIG. 8, an ion transfer tube 216 in accordance with the instant teachings is employed in order to transfer ions entrained in a flowing background gas from an ionization chamber 14 to an intermediate vacuum chamber 18. Other reference numbers and features shown in FIG. 8 are similar to those shown and previously discussed with reference to FIG. 1. The ion transfer tube 216 may comprise any one of the ion transfer tubes shown in FIGS. 3-7 or may even include combinations of the features shown in FIGS. 3-7 or features which are intermediate to the featured shown in those figures. Alternatively, the ion transfer tube may comprise an electrode for creating a static or varying electric field for either guiding or propelling the ions through the ion transfer tube. For instance, the ion transfer tube may consist of an electrically conductive material to which a static or varying electrical potential is applied by means of electrical connections (not shown) to the ion transfer tube. As another example, the ion transfer tube may comprise an electrically non-conductive material, such as glass having one or more portions to which an electrically conductive coating is applied. Multiple such coatings (for instance, at either end of the ion transfer tube) may be used to create an electrical potential gradient along the length of the ion transfer tube. With regard to the mass analyzer 28, it will be apparent to those skilled in the art that this component may include, and is not limited to a quadrupole mass analyzer, a time of flight (TOF) mass analyzer, a Fourier Transform mass analyzer, an ion trap, a magnetic sector mass analyzer or a hybrid mass analyzer.

Figure 9:
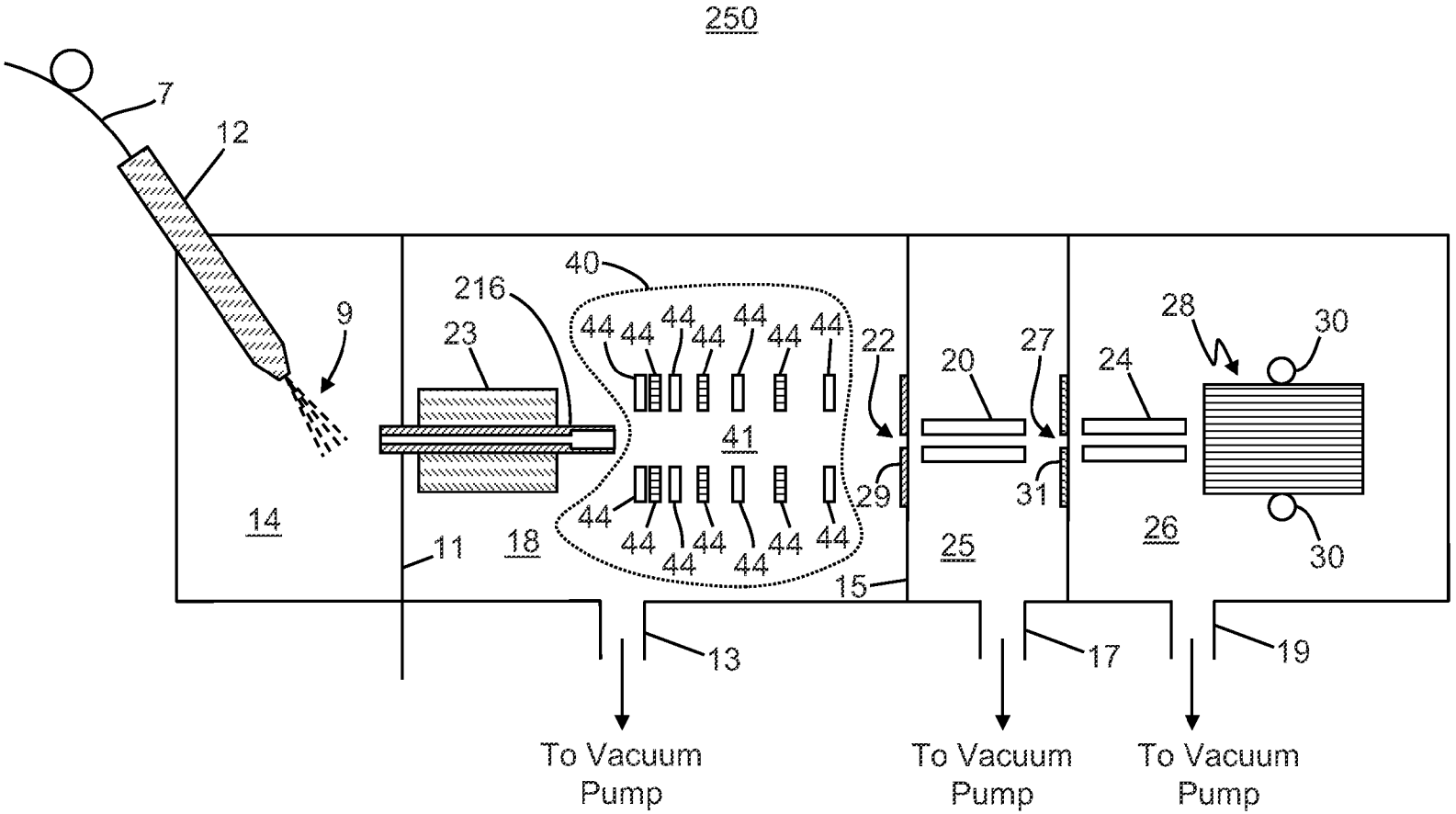
FIG. 9 is a schematic view of another mass spectrometer system in accordance with various embodiments of the instant teachings.

FIG. 9 is a schematic depiction of another mass spectrometer system 250 incorporating an ion transfer tube 216 constructed in accordance with the instant teachings. Analyte ions may be formed by API source 12 within an ionization chamber 14. The analyte ions, together with background gas and partially desolvated droplets, flow into the inlet end of a ion transfer tube 216 in accordance with the instant teachings and traverse the length of the tube under the influence of a pressure gradient through the first partition element or wall 11. The ion transfer tube 216 may comprise any one of the ion transfer tubes shown in FIGS. 3-7 or may even include combinations of the features shown in FIGS. 3-7 or features which are intermediate to the features shown in those figures. The ion transfer tube 216 is preferably held in good thermal contact with a heater element or block 23. The analyte ions emerge from the outlet end of ion transfer tube 216, which opens to an entrance of an ion transport device 40 located within chamber 18. As indicated by the arrow adjacent to vacuum port 13, chamber 18 is evacuated by a mechanical pump or equivalent. Under typical operating conditions, the pressure within chamber 18 will be in the range of 1-50 Torr.

The analyte ions exit the outlet end of ion transfer tube 216 as a free jet expansion and travel through an ion channel 41 defined within the interior of ion transport device 40. As discussed in further detail in US Patent Publication 2009/0045062 A1, the entire disclosure of which is incorporated herein by reference, radial confinement and focusing of ions within ion channel 41 are achieved by application of oscillatory voltages to apertured electrodes 44 of ion transport device 40. As is further discussed in US Patent Publication 2009/0045062 A1, transport of ions along ion channel 41 to the device exit may be facilitated by generating a longitudinal DC field and/or by tailoring the flow of the background gas in which the ions are entrained. Ions leave the ion transport device 40 as a narrowly focused beam and are directed through aperture 22 of extraction lens 29 into chamber 25. The ions pass thereafter through ion guides 20 and 24 and are delivered to a mass analyzer 28 (which, as depicted, may take the form of a conventional two-dimensional quadrupole ion trap having detectors 30) located within chamber 26. The mass analyzer 28 could alternatively comprise, a time of flight (TOF) mass analyzer, a Fourier Transform mass analyzer, an ion trap, a magnetic sector mass analyzer or a hybrid mass analyzer. Chambers 25 and 26 may be evacuated to relatively low pressures by means of connection to ports of a turbo pump, as indicated by the arrows adjacent to vacuum port 17 and vacuum port 19. While ion transport device 40 is depicted as occupying a single chamber, alternative implementations may utilize an ion transport device that bridges two or more chambers or regions of successively reduced pressures.

The reader is referred to US Patent Publication 2009/0045062 A1 for more details of the ion transport device 40. Briefly, the ion transport device 40 is formed from a plurality of generally planar electrodes 44 arranged in longitudinally spaced-apart relation (as used herein, the term "longitudinally" denotes the axis defined by the overall movement of ions along ion channel 41). Devices of this general construction are sometimes referred to in the mass spectrometry art as "stacked-ring" ion guides. Each electrode 44 is adapted with an aperture through which ions may pass. The apertures collectively define an ion channel 41, which may be straight or curved, depending on the lateral alignment of the apertures. To improve manufacturability and reduce cost, all of the electrodes 44 may have identically sized apertures. An oscillatory (e.g., radio-frequency) voltage source applies oscillatory voltages to electrodes 44 to thereby generate a field that radially confines ions within ion channel 41. In order to create a tapered field that focuses ions to a narrow beam near the exit of the ion transport device 40, the inter-electrode spacing or the oscillatory voltage amplitude is increased in the direction of ion travel.

The electrodes 44 of the ion transport device 40 may be divided into a plurality of first electrodes interleaved with a plurality of second electrodes, with the first electrodes receiving an oscillatory voltage that is opposite in phase with respect to the oscillatory voltage applied to the second electrodes. Further, a longitudinal DC field may be created within the ion channel 41 by providing a DC voltage source (not illustrated) that applies a set of DC voltages to electrodes 44 in order to assist in propelling ions through the ion transport device 40.

Figure 10:
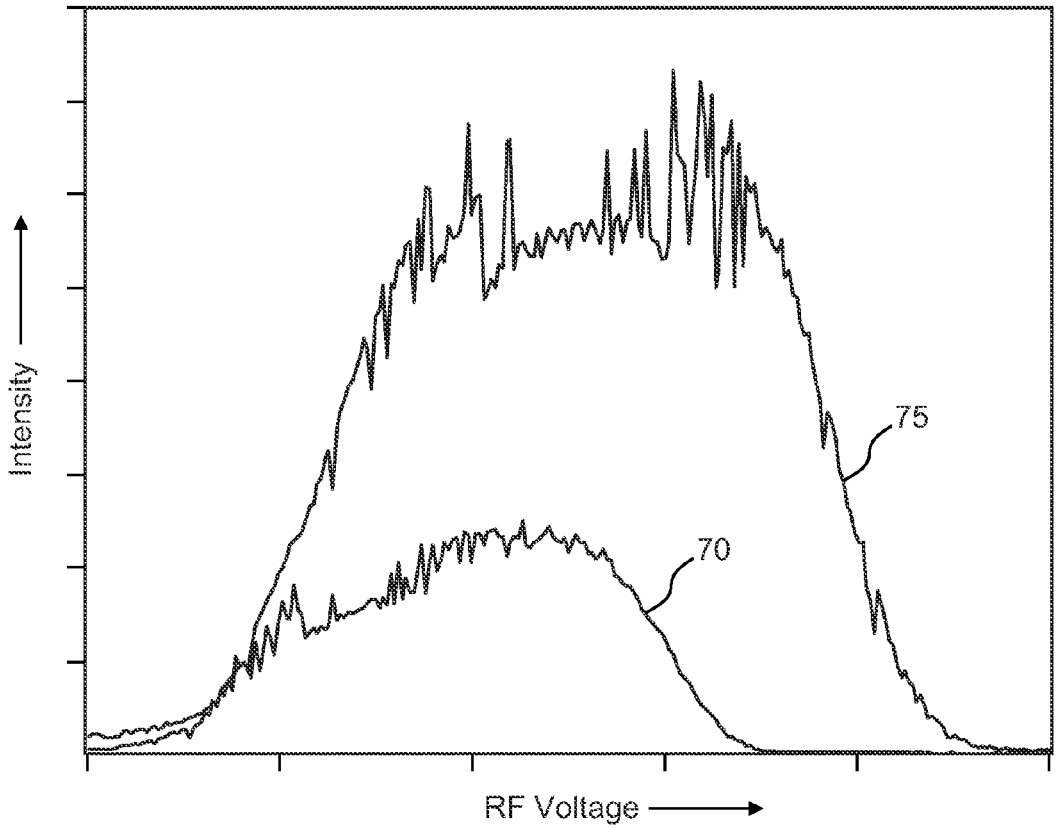
FIG. 10 is a graph depicting the transmission, through a stacked ring ion guide (SRIG), of the doubly charged molecular ion of the hexapeptide ALELFR (Ala-Leu-Glu-Leu-Phe-Arg) versus RF voltage applied to the SRIG, using both a conventional ion transfer tube and an ion transfer tube in accordance with the present teachings to transfer ions from an atmospheric pressure ion source to the SRIG.

The transmission efficiency through the ion transport device 40 is dependent on the amplitude of the applied RF voltage and generally exhibits a point or region of maximum transmission efficiency in a plot against RF amplitude as shown in FIG. 10. The graphical plots in FIG. 10 illustrate the detected ion abundance of the doubly charged molecular ion of the hexapeptide ALELFR (Ala-Leu-Glu-Leu-Phe-Arg) through a mass spectrometer system as depicted in FIG. 9, plotted versus RF voltage amplitude. The curve 70 represents detected ion abundance when a conventional ion transfer tube is employed within the mass spectrometer system; the curve 75 represents the detected ion abundance when an ion transfer tube in accordance with the present teachings is employed.

Figure 12:
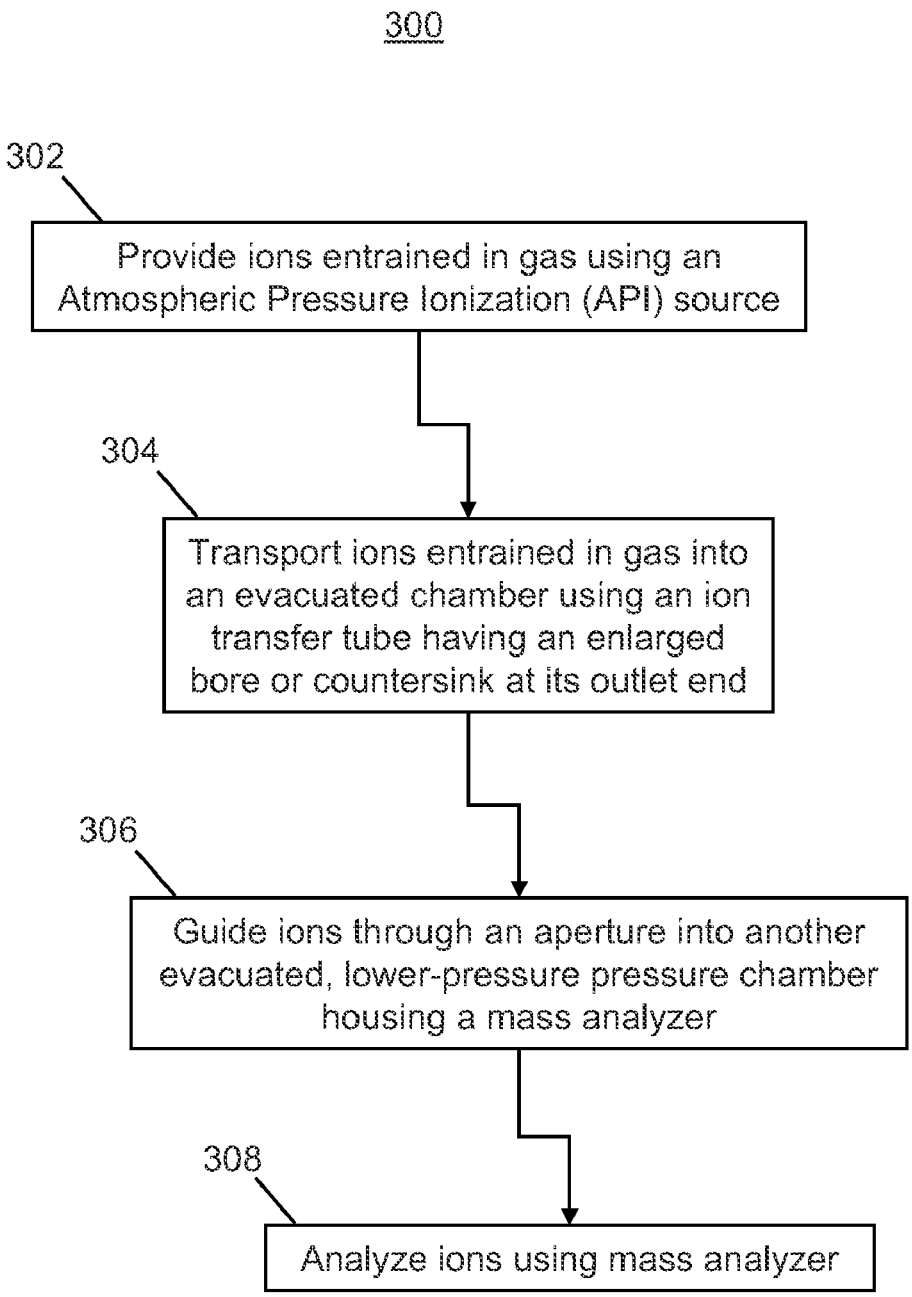
FIG. 12 is a flowchart of a method for analyzing ions in a mass spectrometer apparatus in accordance with the instant teachings.

FIG. 12 is a flowchart of a method for analyzing ions in a mass spectrometer apparatus in accordance with the instant teachings. The first step, Step 302, in the method 300 comprises providing ions entrained in gas using an Atmospheric Pressure Ionization (API) source. Any known API source may be used, such as an electrospray ionization (ESI) source, a heated electrospray ionization (H-ESI) source, an atmospheric pressure chemical ionization (APCI) source, an atmospheric pressure matrix assisted laser desorption source, a photoionization source, or a source employing any other ionization technique that operates at pressures substantially above the operating pressure of a mass analyzer of the mass spectrometer apparatus. In the next step, Step 304, the ions entrained in gas are transported into an evacuated chamber using an ion transfer tube having an enlarged bore or a countersink at its outlet end. In the next step, Step 306 of the method 300, at least a portion of the ions is guided, using ion lenses or other ion optics, or other ion optical assemblies, through an aperture into another evacuated, lower-pressure pressure chamber housing a mass analyzer. The enlarged bore or a countersink of the ion transfer tube utilized in Step 304 is such that either the transmission efficiency of or the preservation of the mass-to-charge composition of the ions through the aperture (or both) is greater than or better than the transmission efficiency or preservation of mass-to-charge composition of ions transmitted through the aperture in the absence of the enlarged bore or countersink. Finally, in Step 308, at least a portion of the ions are analyzed using the mass analyzer.

The inventors have discovered that, with respect to conventional ion transfer tubes, the ion transfer tubes in accordance with the instant teachings can improve the overall transmission efficiency of ions to a mass analyzer and also improve the representativeness of the mass-to-charge composition or distribution of the ions transmitted to the mass analyzer. Stated in another way, the ion transfer tubes disclosed herein can transport a higher proportion of ions within a range of mass-to-charge ratios and can better preserve the mass-to-charge composition of the originally formed ions during such transport relative to conventional ion transfer tubes. The gas throughput of an ion transfer tube (and thereby the pumping requirements) according to the instant teachings is not expected to be increased, as the restriction formed by a relatively long length of the smaller diameter is not affected by having a small fraction of the ion transfer tube length at an increased diameter.

A consideration in regards to the allowed ratio of diameters is that the step cannot alter the diameter too much because then the effect would be the same as just exiting the capillary in the large volume earlier on. Also, the length required to reestablish laminar flow would be much longer if the diameter were larger (having the same $L_1/D$ ratio).

The discussion included in this application is intended to serve as a basic description. Although the present invention has been described in accordance with the various embodiments shown and described, one of ordinary skill in the art will readily recognize that there could be variations to the embodiments and those variations would be within the spirit and scope of the present invention. The reader should be aware that the specific discussion may not explicitly describe all embodiments possible; many alternatives are implicit. Accordingly, many modifications may be made by one of ordinary skill in the art without departing from the spirit, scope and essence of the invention. Neither the description nor the terminology is intended to limit the scope of the invention.

What is claimed is:

1. An ion transfer capillary tube for transferring background gas and entrained ions from an ionization chamber at substantially atmospheric pressure to an evacuated chamber of a mass spectrometer system, the ion transfer capillary tube comprising an inlet end for receiving the background gas and entrained ions within the ionization chamber, an outlet end for delivering the background gas and entrained ions to the evacuated chamber, an interior bore for transferring the background gas and entrained ions from the inlet end to the outlet end, and a portion having a cylindrical outer surface of constant outer diameter that mates with an internal bore of an enclosing body such that the ion transfer capillary tube is slideably removable from the enclosing body and mass spectrometer system in the direction opposite to the direction of travel of the ions during operation of the system, wherein the improvement comprises:

a portion of the interior bore adjacent to and at the outlet end having an inner diameter that is greater than an inner diameter of an adjoining portion of the interior bore.

2. An ion transfer capillary tube as recited in claim 1, wherein the portion of the interior bore adjacent to and at the outlet end comprises a counterbore.

3. An ion transfer capillary tube as recited in claim 2, wherein the depth of the counterbore is greater than the length of a region of disturbed flow that is produced in the background gas with entrained ions when the background gas with entrained ions flows into the portion of the interior bore adjacent to and at the outlet end.

4. An ion transfer capillary tube as recited in claim 2, wherein the depth of the counterbore is greater than the length of a region of turbulent flow that is produced in the background gas with entrained ions when the background gas with entrained ions flows into the portion of the interior bore adjacent to and at the outlet end.

5. An ion transfer capillary tube as recited in claim 2, wherein the depth of the counterbore is at least 60 micrometers.

6. An ion transfer capillary tube as recited in claim 1, wherein the portion of the interior bore adjacent to and at the outlet end comprises a region of continuous inner diameter increase in the direction in which the background gas and entrained ions are transferred.

7. An ion transfer capillary tube as recited in claim 6, wherein the region of continuous inner diameter increase comprises a frustoconical inner surface of the ion transfer capillary tube.

8. An ion transfer capillary tube as recited in claim 7, wherein, in a cross section parallel to an axis of the ion transfer capillary tube, the intersection of the frustoconical surface with the cross section is disposed at an angle of from 54-64 degrees relative to the axis of the ion transfer capillary tube.

9. An ion transfer capillary tube as recited in claim 6, wherein the region of continuous inner diameter increase comprises a countersink.

10. An ion transfer capillary tube as recited in claim 1, wherein the portion of the interior bore adjacent to and at the outlet end comprises a region of discontinuous inner diameter increase in the direction in which the background gas and entrained ions are transferred.

11. An ion transfer capillary tube for transferring background gas and entrained ions from an ionization chamber at substantially atmospheric pressure to an evacuated chamber of a mass spectrometer system, the ion transfer capillary tube comprising an inlet end for receiving the background gas and entrained ions within the ionization chamber, an outlet end for delivering the background gas and entrained ions to the evacuated chamber, an interior bore for transferring the background gas and entrained ions from the inlet end to the outlet end, a first portion having a cylindrical outer surface of constant outer diameter that mates with and is in thermal contact with an internal bore of an enclosing heater such that the ion transfer capillary tube is slideably removable from the enclosing heater and mass spectrometer system in the direction opposite to the direction of travel of the ions during operation of the system, and a second portion adjacent to and at the outlet end having a beveled or chamfered outer surface for mating with a vacuum sealing element or valve such that an outer diameter of the second portion of the ion transfer capillary tube decreases towards the outlet end, wherein the improvement comprises:

a portion of the interior bore adjacent to and at the outlet end having an inner diameter that is greater than an inner diameter of an adjoining portion of the interior bore.

12. An ion transfer capillary tube as recited in claim 11, wherein the portion of the interior bore adjacent to and at the outlet end comprises a counterbore.

13. An ion transfer capillary tube as recited in claim 12, wherein the depth of the counterbore is greater than the length of a region of disturbed flow that is produced in the background gas with entrained ions when the background gas with entrained ions flows into the portion of the interior bore adjacent to and at the outlet end.

14. An ion transfer capillary tube as recited in claim 12, wherein the depth of the counterbore is greater than the length of a region of turbulent flow that is produced in the background gas with entrained ions when the background gas with entrained ions flows into the portion of the interior bore adjacent to and at the outlet end.

15. An ion transfer capillary tube as recited in claim 12, wherein the depth of the counterbore is at least 60 micrometers.

16. An ion transfer capillary tube as recited in claim 11, wherein the portion of the interior bore adjacent to and at the outlet end comprises a region of continuous inner diameter increase in the direction in which the background gas and entrained ions are transferred.

17. An ion transfer capillary tube as recited in claim 16, wherein the region of continuous inner diameter increase comprises a frustoconical inner surface of the ion transfer capillary tube.

18. An ion transfer capillary tube as recited in claim 17, wherein, in a cross section parallel to an axis of the ion transfer capillary tube, the intersection of the frustoconical surface with the cross section is disposed at an angle of from 54-64 degrees relative to the axis of the ion transfer capillary tube.

19. An ion transfer capillary tube as recited in claim 16, wherein the region of continuous inner diameter increase comprises a countersink.

20. An ion transfer capillary tube as recited in claim 11, wherein the portion of the interior bore adjacent to and at the outlet end comprises a region of discontinuous inner diameter increase in the direction in which the background gas and entrained ions are transferred.

21. An improved method for analyzing a sample, the method including the steps of (a) generating ions from the sample within an ionization chamber at substantially atmospheric pressure; (b) entraining the ions in a background gas; (c) transferring the background gas and entrained ions to an evacuated chamber of a mass spectrometer system using an ion transfer capillary tube comprising an inlet end for receiving the background gas and entrained ions within the ionization chamber, an outlet end for delivering the background gas and entrained ions to the evacuated chamber, an interior bore for transferring the background gas and entrained ions from the inlet end to the outlet end, and a portion having a cylindrical outer surface of constant outer diameter that mates with an internal bore of an enclosing body such that the ion transfer capillary tube is slideably removable from the enclosing body and mass spectrometer system in the direction opposite to the direction of travel of the ions during operation of the system; and (d) analyzing the ions using a mass analyzer of the mass spectrometer system, wherein the improvement comprises:

in the transferring step (c), transferring the background gas and entrained ions through a portion of the interior bore adjacent to and at the outlet end having an inner diameter that is greater than an inner diameter of an adjoining portion of the interior bore.

* * * * *